United States Patent [19]

Hutter, III

[11] 4,371,094

[45] Feb. 1, 1983

[54] BARRIER TWO PART PAIRING AND DISPENSING CARTRIDGE

[75] Inventor: Charles G. Hutter, III, Carson City, Nev.

[73] Assignee: Products Research & Chemical Corporation, Glendale, Calif.

[21] Appl. No.: 174,117

[22] Filed: Jul. 31, 1980

[51] Int. Cl.[3] ..... F04B 9/14

[52] U.S. Cl. ..... 222/1; 222/136; 366/333

[58] Field of Search ..... 222/129, 135, 136, 145, 222/1; 128/218 M; 366/332, 333

[56] References Cited

U.S. PATENT DOCUMENTS 3,153,531 10/1964 Cook ..... 259/113
3,164,303 1/1965 Trautmann ..... 222/136 X
3,217,946 11/1965 Cook ..... 222/386
3,475,010 10/1969 Cook et al. ..... 222/136 X
3,707,146 12/1972 Cook et al. ..... 128/2 R

FOREIGN PATENT DOCUMENTS 1214053 12/1970 United Kingdom ..... 128/218 M

*Primary Examiner*—David A. Scherbel
*Attorney, Agent, or Firm*—Poms, Smith, Lande & Rose

[57] ABSTRACT

A dispensing cartridge for separately storing two materials until the time of use in two compartments divided by a barrier assembly. The elements that comprise the barrier assembly are used to divide the cartridge into two compartments, to mix the two materials, and to extrude the mixed material.

7 Claims, 13 Drawing Figures

Fig. 4.
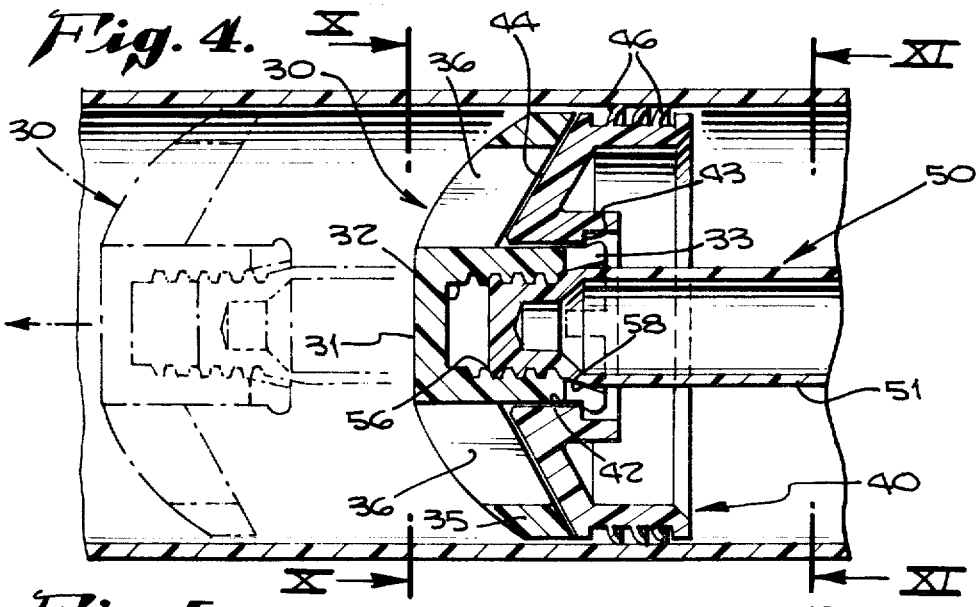
Fig. 5.
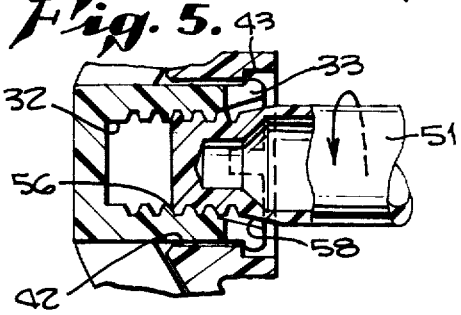
Fig. 6.
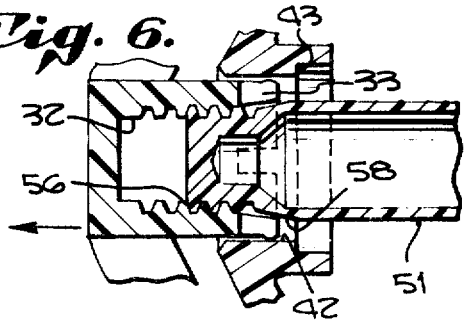
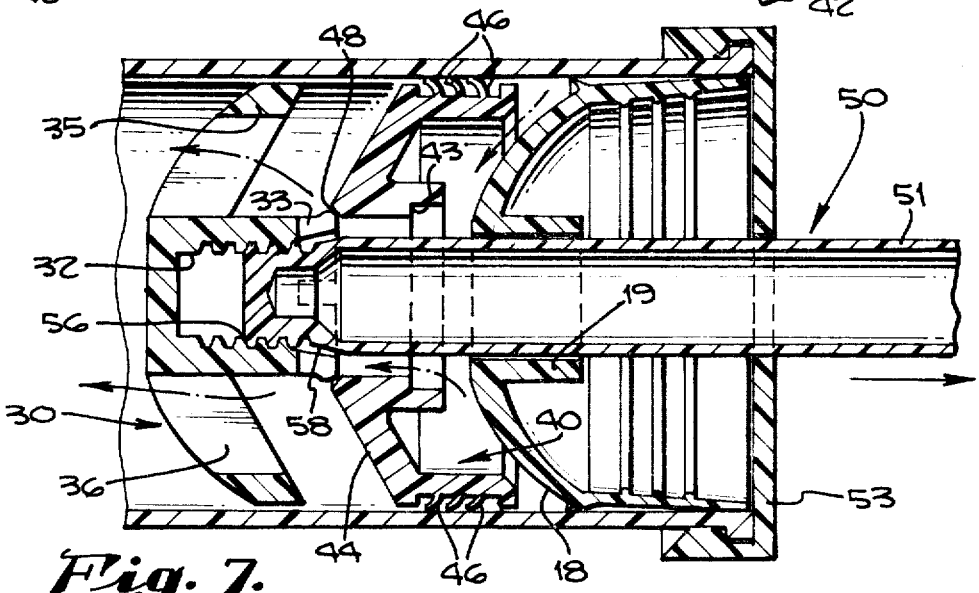
Fig. 7.

Fig. 12.
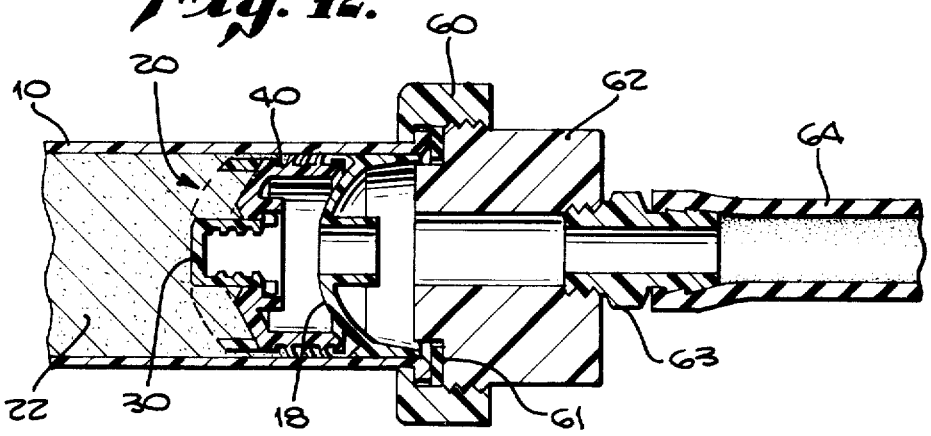
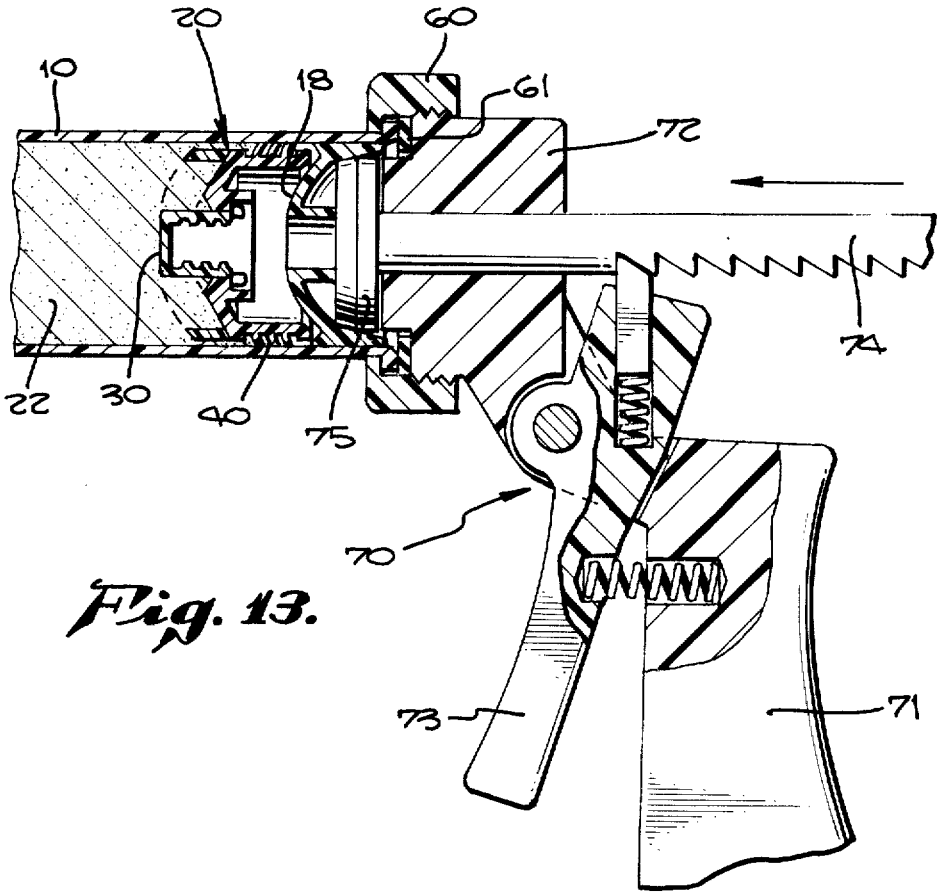
Fig. 13.

BARRIER TWO PART PAIRING AND DISPENSING CARTRIDGE

BACKGROUND OF THE INVENTION

1. Field of the Invention

This invention broadly relates to a container for separately storing a plurality of materials that are to be mixed only at a time of use and then dispensing the mixed materials, and more particularly relates to a cartridge container for separately storing two materials and having a means for mixing the two materials in the cartridge at the time of use and means for dispensing the mixed materials from the cartridge.

2. Description of the Prior Art

The prior art devices of this type have employed barriers for separating the materials within the cartridge which at the time of use are ruptured and pushed aside prior to mixing and dispensing. Further, some of these prior art devices have employed dasher operating rods which were utilized only for mixing and then discarded for the dispensing operation. Further, prior art devices have employed separate dispensing pistons in addition to separate barrier members and separate dasher members which resulted in more complex and expensive devices.

Examples of these prior art devices can be found in U.S. Pat. Nos. 3,153,531, 3,707,146, 3,475,010, and 3,217,946.

A cartridge more pertinent to the present invention is described in U.S. Pat. No. 3,164,303. This cartridge embodies a barrier and a dasher which are releasably screwed together to form an impervious barrier in the cartridge. An operating rod is integrally attached to the dasher. One end of the cartridge is provided with a dispensing nozzle, and the other end is provided with an end wall which seals the back compartment and provides a sleeve orifice for the operating rod to slide within. The patent discloses that the front compartment can be filled through a suction operation whereby the plunger is pulled back from a front position to draw in the desired amount of material. The back compartment is filled either by pouring the material into the back compartment prior to placement of the end wall or by first positioning the end wall and then introducing the material through a small passage in the end wall.

It is to be noted that in all cases, because the operating rod is integrally fixed to the dasher, the back compartment is filled with the operating rod in position. This necessitates that the end wall be either positioned after the back compartment has been filled (which can be messy and make it difficult to remove the trapped air) or initially positioning the end wall and filling the back compartment through a small passageway in the end wall (which creates additional sealing problems after the filling operation).

It is also noted that because the operating rod is permanently fixed to the dasher, the contents of the cartridge cannot be ejected by pneumatic means or ratchet guns.

This prior art device is operated by first unscrewing the dasher from the barrier and then pulling the dasher to the back end of the cartridge which will also push the barrier to the back wall. When the dasher and barrier are unscrewed, a passageway is provided which allows the dasher and barrier to be pulled back through the material. Then the dasher is reciprocated through the length of the cartridge to mix the material. After mixing the material, the dasher is then screwed back into the barrier to thereby create an impervious plunger which must be pushed forward to extrude the mixed material out of the cartridge nozzle.

SUMMARY OF THE INVENTION

Broadly, the invention is an apparatus and method for separately storing a plurality of materials, mixing the materials, and dispensing the mixed materials. The apparatus broadly comprises a cylindrical body having orifices at each end, a barrier assembly positioned within the cylindrical body and creating a front compartment and a back compartment. The barrier assembly comprises a mixer or dasher member which is sized to move freely within the walls of the cylinder and a sealing member which is releasably engaged with the dasher and is sealingly and slideably positioned within the walls of the cylinder. The dasher is positioned forwardly of the sealing member. The apparatus further includes an operating rod which is positioned through the orifice at the back end of the cylinder, through the back compartment and into adjustable engagement with the dasher.

In operation, one material is introduced into the front compartment through the front orifice and a second material is introduced into the back compartment through the back orifice, prior to insertion of the operating rod.

The front orifice can be sealed or provided with a nozzle closure which can be opened at the time of dispensing. The back orifice is sealed by means of the operating rod being in sealing and sliding engagement with the walls of the back orifice.

The apparatus is shipped in this filled condition to the user. When it is desired to use the apparatus, the user slideably disengages the dasher from the sealing member, and then pulls both the dasher and the sealing member back to the back end of the cylinder. This movement is possible in the filled cylinder because when the dasher and sealing member are disengaged, the material in the back compartment can pass through the sealing member and past the dasher. Once the sealing member has been positioned at the back of the cylinder, the dasher can be fully reciprocated within the cylinder to mix the two materials.

The next step is to slideably re-engage the dasher and the sealing member so as to again constitute the barrier assembly. The front orifice is then opened or the nozzle is opened, and the barrier assembly is pushed forward to dispense the mixed material.

The barrier assembly can be pushed forward by exerting a forward force on the operating rod, by providing pneumatic pressure at the rear end of the cylinder, or by applying force to the barrier assembly with the ram of a ratchet-type dispensing gun.

It is an object of this invention to provide a novel dispensing cartridge with fewer parts.

Another object of this invention is to provide a dispensing cartridge which does not require any disassembly to use.

A further object of this invention is to provide a dispensing cartridge having a barrier less susceptible to damage and malfunction.

Yet another object of this invention is to provide a dispensing cartridge which is completely manually operable.

Another object of this invention is to provide a dispensing cartridge which can be actuated by either manual, pneumatic, or mechanical piston methods.

Still another object of this invention is to provide a dispensing cartridge having a novel barrier assembly which serves as the barrier, the mixer, and the extruding piston.

A further object of this invention is to provide a novel method of separately storing two materials, mixing the materials, and then dispensing the mixed material.

Yet another object of this invention is to provide a dispensing cartridge with separate storage compartments which can be filled after the end wall is positioned and before the operating rod is secured to the dasher or barrier.

Another object of the invention is to provide a dispensing cartridge wherein the dasher and sealing member are in slideable and releasable engagement with each other and the operating rod can lockingly engage the dasher to the sealing member.

A further object of the invention is to provide a novel method of filling a dual compartment container.

Another object of this invention is to provide a novel method of operating a dual compartment dispensing container.

These and other objects and advantages which are inherent in the invention will be apparent to those skilled in the art after reading the following detailed description.

This invention will now be described by reference to a specific embodiment and the accompanying drawings, and which embodiment is considered to be the best mode presently contemplated for carrying out the invention.

BRIEF DESCRIPTION OF THE DRAWINGS

FIG. 4 is the cross-sectional view taken along the line IV—IV of FIG. 3, and shows the structural relationship of the dasher, sealing member, and operating rod, and the movement of the sliding member in phantom.

FIG. 5 is a partial, cross-sectional view of the barrier assembly and operating rod, showing how the dasher can be disengaged from the sealing member.

FIG. 6 is a partial, cross-sectional view, similar to FIG. 5, showing the dasher being slideably separated from the sealing member.

FIG. 7 is a cross-sectional view showing the sealing member in its most rearward position, and the dasher being moved forward away from the sealing member.

FIG. 12 is a cross-sectional view showing how material is ejected from the cartridge by the application of pneumatic pressure to the rear end of the cartridge.

FIG. 13 is a cross-sectional view showing how material is ejected from the cartridge by the application of mechanical force via a ratchet-type dispensing gun.

DETAILED DESCRIPTION OF THE INVENTION

Figures 1, 2, 3:
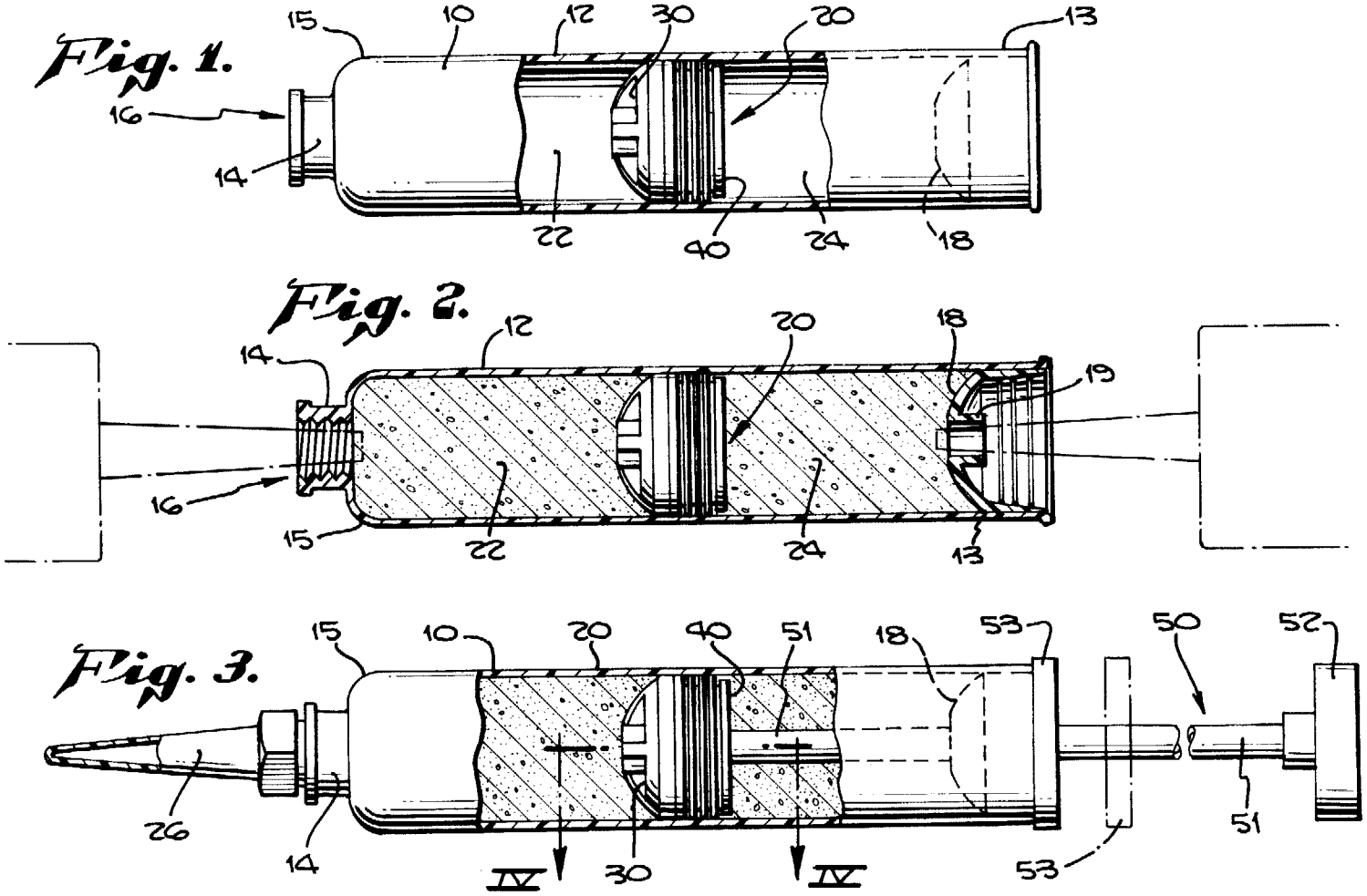
FIG. 1 is a side view, partially in cross-section of the cylindrical cartridge to be used in this invention showing the barrier assembly dividing the cartridge into two empty compartments.
FIG. 2 is a side, cross-sectional view of the cartridge of FIG. 1, shown being filled at both ends.
FIG. 3 is a side view, partially in cross-section, of the cartridge in FIG. 1, showing the operating rod inserted and in engagement with the dasher.
Figure 11:
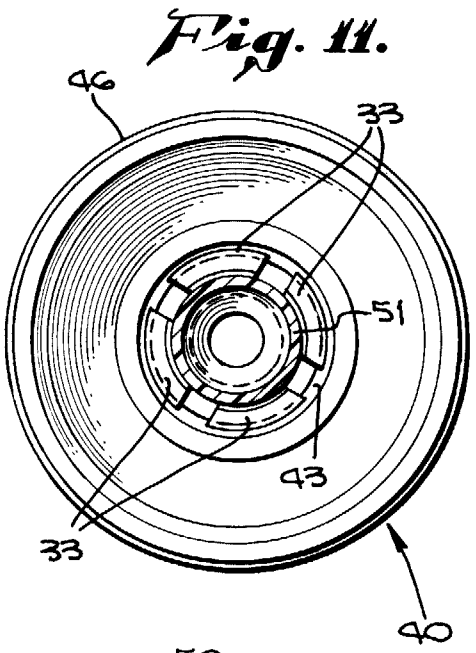
FIG. 11 is the view, taken along the lines XI—XI of FIG. 4, of the back of the barrier assembly, not including the walls of the cartridge.
Figure 10:
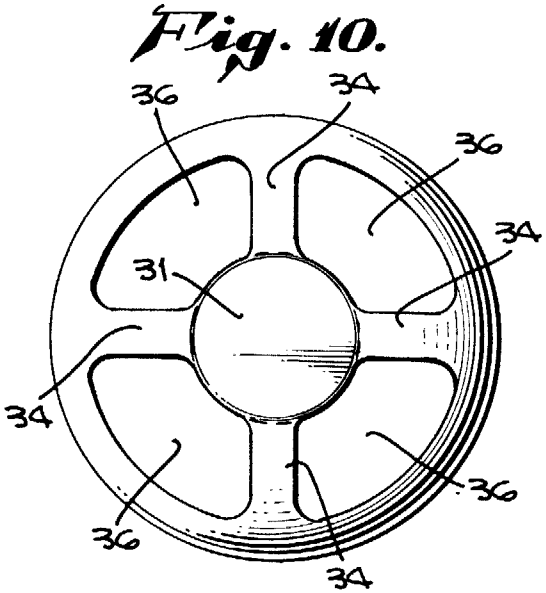
FIG. 10 is the view, taken along lines X—X of FIG. 4, of the front of the dasher, not including the walls of the cartridge.
Figure 8:
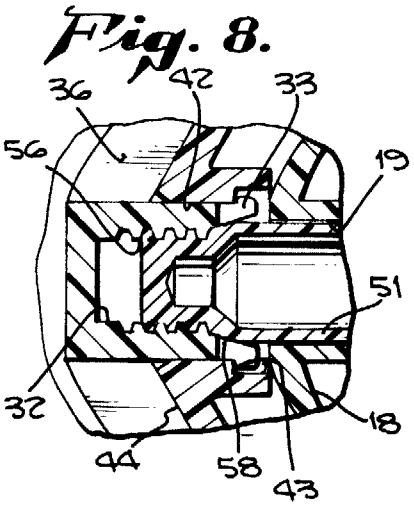
FIG. 8 is a partial, cross-sectional view of the connection between the barrier assembly and the operating rod.
Figure 9:
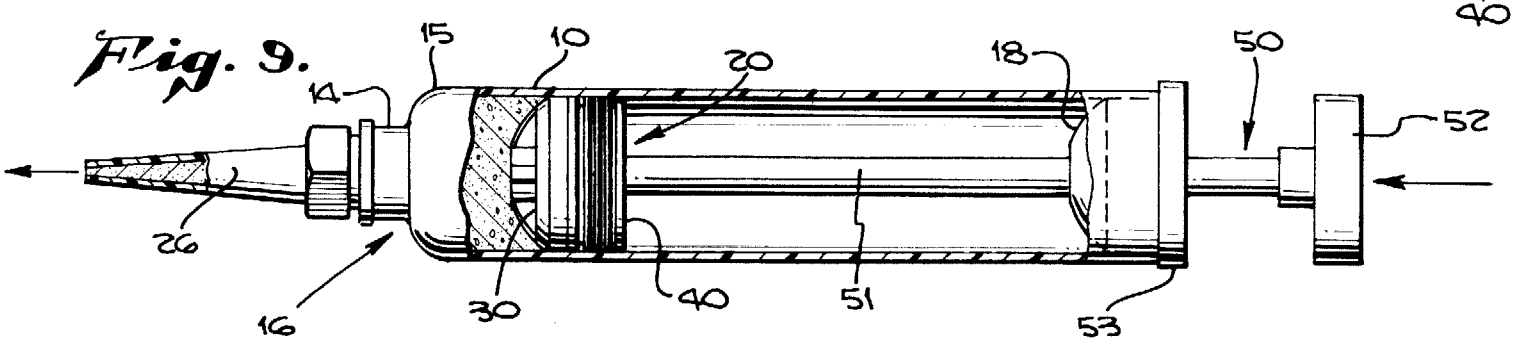
FIG. 9 is a side view, partly in cross-section, showing the operation of the barrier assembly and the operating rod dispensing the mixed material.

The drawings show the presently preferred embodiment of the invention in the form of a disposable cartridge, generally designated at 10, to contain, for example, a sealant which is to be compounded at the time of use by mixing a base material with a catalyst or accelerator. It is to be understood however, that the invention may be employed to mix other materials for other purposes.

The cartridge comprises a thin walled cylindrical body 12 which is preferably made of a suitable plastic material such as polyethylene, the body 12 being open at the back end 13, and the body 12 having a protruding, internally-threaded neck 14 at the front end 15 which defines the dispensing outlet 16. The neck 14 is threaded so that the dispensing outlet can be closed with a cap or with a dispensing nozzle.

Shown in FIG. 1, and more clearly in FIG. 2, is an end closure 18 which is fixedly attached to the terminal circumference of the cylindrical body 12. The end closure 18 is provided with a central, axially extending sleeve 19 which is adapted to serve as a material inlet and also as a guiding sleeve for the operating rod to be described later.

Included within the cartridge, and positioned within the body 12 is a barrier assembly generally designated at 20. The barrier assembly 20 is better seen in FIGS. 4 and 7 and comprises a mixing member or dasher 30 and a sealing member 40. Prior to the placement of the end closure 18 in cartridge 10, the barrier assembly 20 is inserted into the cartridge 10 from the back end 13 and positioned so as to divide the inside of the cartridge into two appropriately sized compartments, a front compartment 22 and a back compartment 24.

After the barrier assembly 20 has been inserted and properly positioned, the end closure 18 is attached to the back end 13 of the cartridge 10, and then the two desired materials can be injected into the front compartment 22 via dispensing outlet 16 and into the rearward compartment 24 via sleeve 19, using injection bottles as shown in FIG. 2 or any other means known in the art.

Because end closure 18 is attached to the back end 13 of the cartridge 10 prior to the introduction of the material into the back compartment, it can be more effectively sealed to the cartridge by many means known to the art without concern for the presence of any material in the cartridge and without concern for air being trapped in the back compartment. Further, because the operating rod has not yet been attached to the dasher or barrier assembly, the material can be introduced through the axially extending sleeve 19 which will later receive and be sealed by the operating rod, thereby avoiding the need for an additional filling orifice in the end closure and the attendant sealing problems it would create.

Referring now to FIG. 3, a sealing nozzle closure 26 is threadedly fastened to the neck 14. Nozzle closure 26 provides the necessary closure during transport and storage of the cartridge; and at the time of use, the end of the nozzle 26 can be snipped off to allow dispensing of the mixed material.

Also shown in FIG. 3 is the operating rod 50 which comprises a long cylindrical rod 51, a plunger knob 52 fixedly secured to the rear end of the rod 51, being threaded at the front end of the rod 51 for threadable engagement with the dasher 30, and having an end cap 53 through which the rod 51 slides and for snapping onto the back end 13 of the cartridge 10 to insure that any material that may leak past the sleeve 19 will be retained within the end cap 53.

After the two compartments have been filled with the required material, and prior to shipment, the operating rod 50 is inserted into the container and assembled to the dasher, as described hereinafter. The rod 51 is inserted into the sleeve 19 with which it has a sliding and sealing relationship. The rod 51 is hollow and its leading end is closed and threaded. The rod 51 is closed at the leading end in order to allow the end of the rod to be threaded into the dasher in the presence of the material in the rear compartment, without material entering the rod.

Turning now to FIG. 4, the threaded connection between the threaded opening 32 and the threaded end of the rod 51 is loose enough to allow whatever material is present in the threaded opening 32 to be extruded out between the threads as the rod is threaded into the dasher.

The detailed construction and arrangement of the dasher 30, the sealing member 40, the barrier assembly 20, and the operating rod 50 will now be described. The dasher 30 comprises a central core 31 having a threaded opening 32 open to the rear side of the dasher for receiving the threaded end of the rod 51. The central core 31 has a uniform outer circumference so that it can be slidingly received by the central sleeve orifice 42 in the sealing member 40. The terminal end of the central core 31 is provided with circumferentially-spaced, resilient locking members 33 which extend in a radial, outward direction. During the initial assembly of the barrier assembly 20, the central core 31 of the dasher 30 is slid into the central sleeve orifice 42 of the sealing member 40. The resilient locking members 33 are radially compressed while in contact with the inner surface of the central sleeve orifice 42, until the dasher is inserted far enough so that the resilient locking members 33 return to their natural position in engagement behind the circumferential locking shoulder 43.

The dasher 30 is further provided with integral arm members 34 extending radially outward from the central core 31, which are integrally connected to each other at their terminal ends by a cylindrical peripheral portion 35. The peripheral portion 35 is sized so that it nearly approaches the inner wall of the cartridge 10. It will be appreciated, however, that the dasher 30 can be sized so that the peripheral portion 35 is in sealing contact with the inner wall so long as the dasher can be freely reciprocated within the cartridge to serve its function of mixing the material. The central core 31, the arms 34, and the peripheral portion 35 together define a plurality of orifices or passageways 36 through the dasher 30. These passageways 36 allow the dasher 30 to move through the material as described later, and the arms 34 and the peripheral portion 35 serve to mix the material as will also be described later. It will be appreciated that many other configurations for the arms and peripheral portion could be devised, so long as the mixing function would be accomplished.

Turning now to the sealing member 40, it comprises the central sleeve orifice 42 which is adapted to slidingly receive the central core 31 of the dasher 30, a locking shoulder 43 to releasably engage the resilient members 33, a barrier portion 44 extending radially from the central sleeve orifice 42, and a plurality of resilient sealing ribs 46 on the peripheral edge of the sealing member 40. The barrier portion 44 and the resilient sealing ribs 46 serve to prevent the unintentional mixing of the separated material. As shown in FIG. 4, the sealing member 40 is provided with a plurality of circumferential sealing ribs 46 to produce a multiple sealing effect. In particular, the resilient sealing ribs 46 are sized so as to constantly apply pressure to the inner wall of the cartridge 10 in order to provide an effective seal. Although the sealing ribs 46 will produce an effective seal, the pressure they exert against the inner wall of the cartridge 10 is not so great as to totally prevent axial movement of the sealing member 40.

When the dasher 30 is in engagement with the sealing member 40, the resulting barrier assembly 20 is imprevious and prevents communication between the front compartment 22 and the back compartment 24.

Turning now to the description of the operating rod 50, it comprises a rod 51, a plunger knob 52 fixedly secured to the rearward end of rod 51, an end cap 53 loosely fitted around rod 51 and adapted to attach to the back end of the cartridge 10, and a threaded front end 56 of the rod 51 for threadable engagement with the threaded opening 32 of the dasher 30. As discussed above, after the dasher 30 has been releasably engaged by the sealing member 40, the rod 51 is threaded into the dasher 30. The rod 51 is provided with a shoulder 58 which, when the rod 51 is threaded into the dasher a sufficient distance will abut against the inside edge of the resilient locking members 33. When the rod shoulder 58 is in this abutting position, the dasher 30 is prevented from being slid out from the sealing member 40 because the rod shoulder 58 prevents the resilient locking members 33 from being compressed radially inward. It is intended and preferred that the loaded cartridge be shipped with the operating rod 50 threaded to this locking position so as to prevent mixing of the material.

METHOD OF OPERATION

When it becomes time to use the loaded cartridge, the following operations and steps are conducted. First, the operating rod 50 is moved axially rearward to the dasher, by unthreading the rod a sufficient amount (e.g. one-half turn), so as to eliminate the locking abutting relationship between the rod shoulder 58 and the resilient locking members 33. This unlocked position and relationship is seen in FIG. 5.

Next, the operating rod 50 is pushed forward to slideably release the engagement of the dasher 30 with the sealing member 40. The dasher 30 is able to move forward through the material in the loaded front compartment 22 because of the passageways 36. FIG. 6 shows the dasher 30 being moved forward through the central sleeve orifice 42. After the resilient locking members 33 have been withdrawn from the central sleeve orifice 42, the resilient locking members 33 are brought into abutting disposition with the sealing member 40. As shown in FIG. 7, the resilient locking members 33 abut a shoulder 48 on the front portion of the sealing member 40. At this point, it may be preferable to move the operating rod axially forward relative to the dasher in order to position the rod shoulder 58 into abutting position with the resilient locking members 33 thereby locking them into their radial outward and disengaged position.

Then, the operating rod 50 is pulled backwards. This pulls the dasher 30 backwards through the injected material, and the abutting relationship between the resilient locking members 33 and the shoulder 48 will push the sealing member 40 backwards ahead of the dasher 30.

Because the resilient locking members 33 are circumferentially spaced, passageways are provided between them which allow the passage of material from behind the sealing member 40 through these passageways and through the dasher 30, as shown by the arrows in FIG. 7.

After the dasher 30 and the sealing member 40 have been pulled completely to the back end of the cartridge 10 so that substantially all of the material loaded into the cartridge is forward of the sealing member 40 (as shown in FIG. 7), then the operating rod 50 is reciprocated forward and back, and rotated if desired, so that the dasher 30 sufficiently mixes the two materials which were initially in the two separated compartments.

Next, after the material has been sufficiently mixed, the dasher 30 is pulled back, the locking abutment between the rod shoulder 58 and the resilient locking members 33 is released, and the dasher is slideably pulled through the sealing member 40 until the resilient locking members 33 snap behind the locking shoulder 43. Then the operating rod 50 is again moved axially forward within the dasher by threading the rod 51 back into the dasher 30 and threaded sufficiently to engage the shoulder 58 on the rod 51 with the inner surface of the resilient locking members 33. This will again lockingly engage the dasher 30 to the sealing member 40 and constitute the barrier assembly 20.

Now, the tip of the nozzle 26 can be snipped off, thereby creating a dispensing nozzle. The mixed material is then extruded from the cartridge by pushing in on the plunger knob 52 which pushes the barrier assembly 20 through the cartridge 10. In this way the barrier assembly 20 acts as a piston to drive the mixed material out of the cartridge 10.

Referring now to FIGS. 12 and 13 which disclose alternative means for ejecting material from the container, FIG. 12 illustrates a pneumatic means for ejection connected to the previously described cartridge 10 with its dasher 30, sealing member 40, and end closure 18. The operating rod 50 and end cap 53 have been removed and a locking ring 60 has been positioned around the end of the cartridge 10. With an annular sealing ring 61 placed between, a pneumatic body member 62 is threaded into the locking ring 60 so as to hermetically seal against the end of the cartridge 10. A hose fitting 63 is threadably engaged with the pneumatic body member 62, and a hose 64 leading from a source of pressurized gas is communicatively connected to the hose fitting 63.

When it is desired to eject the mixed material from the cartridge 10, pressurized gas is fed through the hose 64, hose fitting 63, pneumatic body member 62 and into the cavity behind the barrier assembly 20. The presence of pressurized gas behind the barrier assembly will force the barrier assembly to the left (as seen in FIG. 12) thereby ejecting the mixed material from the cartridge.

Referring now to FIG. 13, there is shown a mechanical ratchet means for ejecting the mixed material. Again there is shown a locking ring 60, and an annular sealing ring 61. Also illustrated is a mechanical ratchet gun 70 including a ratchet handle 71, a ratchet body 72, a ratcher trigger 73, a ram rod 74, and ram head 75. The ratchet body 72 is threadably attached to the locking ring 60, in abutment with the sealing ring 61, in a manner similar to the attachment of the pneumatic body member 62 described above. The ram rod 74 passes through an opening in the ratchet body 72 and terminates in a ram head 75 which abutts the end closure 18.

When it is desired to eject the mixed material, the ratchet gun 70 is operated in the conventional manner and ram head 75 pushes the end closure 18, and the barrier assembly 20 to the left, thereby ejecting the mixed material.

Although the above is a detailed description of the presently preferred embodiment of the invention, various changes and modifications will be obvious to those skilled in the art and are intended to be within the scope of the inventions as defined by the appended claims.

I claim:

1. A dual compartment container for separately storing two materials, subsequently mixing them, and later dispensing the mixture comprising:

a cylindrical body having a sealable orifice at each end thereof;

a barrier assembly disposed within the cylindrical body between the two ends for creating two separated compartments in the cylindrical body and capable of separating two materials, said barrier assembly having a sealing member having slidable, sealing contact with the inner wall of the cylindrical body and a dasher movable axially back and forth toward each of the ends to mix the material to be contained in the cylindrical body, the sealing member and the dasher being normally adjacent each other during the separate storing of the materials and during dispensing of the mixture; and wherein the improvement comprises:

said sealing member having means for releasably engaging and disengaging the dasher, said means comprising a central sleeve orifice and a circumferential locking shoulder;

said dasher having a means for releasably engaging and disengaging the sealing member, said means comprising a central core adapted for axial sliding engagement with the central sleeve orifice, and resilient locking members adapted to releasably engage the circumferential locking shoulder; and a means for moving the dasher comprising a rod attached to the dasher, said attachment allowing the rod to be positioned relative to the dasher in a first position which lockingly engages the dasher to the sealing member and in a second position which permits the dasher to be disengaged from the sealing member.

2. The container defined in claim 1 wherein said resilient locking members are circumferentially spaced about the leading end of the dasher's central core.

3. A dual compartment container for separately storing two materials, subsequently mixing them, and later dispensing the mixture comprising:

a cylindrical body having a sealable orifice at each end thereof;

a barrier assembly disposed within the cylindrical body between the two ends for creating two separated compartments in the cylindrical body and capable of separating two materials, said barrier assembly having a sealing member having slidable, sealing contact with the inner wall of the cylindrical body and a dasher movable axially back and forth toward each of the ends to mix the material to be contained in the cylindrical body, the sealing member and the dasher being normally adjacent each other during the separate storing of the materials and during dispensing of the mixture;

means for axially moving said barrier assembly from one end of the cylindrical body to the other, and wherein the improvement comprises:

said sealing member having means for releasably engaging and disengaging the dasher, said means comprising a central sleeve orifice and a circumferential locking shoulder;

said dasher having a means for releasably engaging and disengaging the sealing member, said means comprising a central core adapted for axial sliding engagement with the central sleeve orifice, and resilient locking members adapted to releasably engage the circumferential locking shoulder, wherein said resilient locking members are circumferentially spaced about the leading end of the dasher's central core; and said moving means having a rod extending partially into the cylindrical body having one end terminating externally of the cylindrical body and attaching means on the end of the rod in the cylindrical body for attaching the internal end of the rod to the dasher, said attachment allowing the rod to be axially movable relative to the dasher between a first position and a second position, and the rod further comprises surface means integral with the rod for abutting the dasher's resilient locking members and for urging the locking members into locking engagement with the sealing member's circumferential locking shoulder when the rod is in the first position and for not abutting said resilient locking members when the rod is in the second position for permitting the resilient locking members to disengage the locking shoulder of the sealing means.

4. The container defined in claim 3 wherein:

said container has only one sealable orifice at one end thereof;

said rod passing through said one sealable orifice in a sliding and sealing relationship, the internal end of the rod being externally threaded.

5. The container defined in claim 3 wherein the attaching means on the internal end of the rod comprising an externally threaded end extending from the surface means, the dasher having an internally threaded opening in its central core extending inward from the resilient locking shoulder whereby the surface means of the rod abuts the resilient locking tabs when the external thread of the rod substantially fully engages the internally threaded opening of the central core.

6. A method of operating a dual compartment container for separately storing two materials, subsequently mixing them, and later dispensing the mixed material wherein the container comprises a cylindrical body having a dispensing orifice at the front end and a rod-receiving orifice at the back end and a barrier assembly disposed within the cylindrical body between the two ends for creating two separated compartments, said barrier assembly having a sealing member and a dasher lockingly engaged to each other, and an operating rod inserted into the back compartment through the rod-receiving orifice and threadably attached to the dasher, said method comprising:

unthreading said rod out of said dasher a sufficient amount to unlock the engagement of the dasher to the sealing member;

moving the dasher forward to release its engagement with the sealing member so as to provide communication between the two compartments;

moving the rod back so as to position the dasher and sealing member at the rear of the container;

moving the rod in a manner to reciprocate the dasher within the container to mix the material;

moving the rod back to axially re-engage the dasher with the sealing member;

threading the rod into the dasher a sufficient amount to lock the engagement of the dasher to the sealing member;

opening said dispensing orifice in the front of the container; and moving the barrier assembly forward to extrude the mixed material from the dispensing orifice.

7. The method defined in claim 6 further including:

prior to positioning the dasher and the sealing member at the rear of the container, threading the rod into the dasher a sufficient amount to lock the dasher into its disengaged position; and prior to axially re-engaging the dasher with the sealing member, unthreading the rod out of the dasher a sufficient amount to unlock the dasher from its disengaged position.

* * * * *